United States Patent [19]

Knaak

[11] 4,056,351

[45] Nov. 1, 1977

[54] WORKPIECE-ENGAGING ELEMENT FOR FURNACES

[75] Inventor: Rüdiger Knaak, Neuss, Germany

[73] Assignee: Koppers-Wistra-Ofenbau GmbH, Dusseldorf, Germany

[21] Appl. No.: 654,917

[22] Filed: Feb. 3, 1976

[30] Foreign Application Priority Data

Feb. 7, 1975 Germany ..... 2505179

[51] Int. Cl.[2] ..... F27B 9/14

[52] U.S. Cl. ..... 432/234; 432/235

[58] Field of Search ..... 432/233, 234, 235, 4, 432/126–128

[56] References Cited

U.S. PATENT DOCUMENTS

| | | | |
|---|---|---|---|
| 3,214,152 | 10/1965 | Molz | 432/235 |
| 3,367,641 | 2/1968 | Molz | 432/234 |
| 3,552,729 | 1/1971 | Hepp | 432/234 |
| 3,588,059 | 6/1971 | Weineck | 432/234 |
| 3,637,198 | 1/1972 | Knaak | 432/234 |
| 3,804,584 | 4/1974 | Herr | 432/234 |

FOREIGN PATENT DOCUMENTS

| | | | |
|---|---|---|---|
| 517,169 | 2/1953 | Belgium | 432/234 |
| 2,143,214 | 3/1973 | Germany | 433/234 |

*Primary Examiner*—John J. Camby
*Assistant Examiner*—Henry C. Yuen
*Attorney, Agent, or Firm*—Michael J. Striker

[57] ABSTRACT

A furnace for the heat treating of workpieces includes an elongated internally-cooled supporting member which supports workpieces which are to be advanced through the furnace and a plurality of workpiece-engaging elements, each having a lower portion mounted on the supporting member and an upper portion which is larger than the lower portion and which has an upwardly-directed planar surface which is adapted to support the workpieces from below.

12 Claims, 5 Drawing Figures

WORKPIECE-ENGAGING ELEMENT FOR FURNACES

BACKGROUND OF THE INVENTION

The present invention relates to metallurgical furnaces in general and, more particularly, to improvements in the design of workpiece-engaging elements used in walking beam and so-called pusher-type furnaces.

Metallurgical furnaces are employed for continuous transport of ingots, slabs, rods, bars or like metallic workpieces through a heating chamber. The so-called pusher-type furnaces employ elongated rails along which the workpieces are pushed through the heating chamber whereby the workpieces are heated from above and from below. A disadvantage of such a furnace is that the surfaces of the workpieces are likely to be scratched or otherwise damaged through sliding movement along the rails which is particularly undesirable when the furnace is employed for the treatment of expensive and highly-sensitive metallic workpieces.

It is known that in such furnaces contact between the workpieces and the rails along which they are pushed results in the formation of strip-like undercooled zones in the region of the workpiece surfaces which contact the support. It will be appreciated that the rails must be cooled, usually by circulating cooling fluid through interior passages of the rails, so that they will not themselves be deformed at the elevated temperatures of the furnace. These undercooled zones or dark strips are very undesirable because they adversely affect material characteristics, particularly during subsequent rolling.

In order to eliminate this problem, the prior art has proposed so-called "riders" or workpiece-engaging elements composed of heat-insulating material and which are fixedly mounted on the rails and extend over the entire length thereof. The workpieces are supported on these riders for the purpose of preventing undercooling of portions of the workpieces which would otherwise be in direct contact with the internally-cooled rails.

However, the prior-art proposals have not proven altogether satisfactory. The higher the requirement which is imposed for preventing the development of undercooled zones in the workpiece, the more complex must be the construction of the riders and the more necessary it is to use expensive highly heat-resistant materials. The construction of riders currently in use are characterized in that they are generally massive and have rather large heights, considerable widths and are constituted of more than one part. For example, it is frequently necessary under circumstances where the temperatures are extremely elevated to use ceramic material for at least the upper portions of the riders. One-piece riders are generally only useful in furnaces where the anticipated temperature ranges are not very high.

In one known application, the rider comprises an upwardly-projecting central portion of rather large height which is flanked by side flanges so as to roughly resemble an inverted U-shaped configuration. This rider sits on the rail by embracing opposite sides thereof. However, the upper workpiece-engaging contact surface of this rider is so greatly spaced from the cooling rail that it is heated to very elevated temperatures which, in turn, means that the upper structural limit of the material of the upper workpiece-engaging portion is soon reached.

In addition, the workpiece-engaging upper surface of the U-shaped rider is at least as wide as the upper width of the elongated rail. This is very undesirable because uniform heating of the underside of the workpiece is possible only if the access of heat to the workpiece is blocked as little as possible between the riders and the rails. This requires that the riders and rails be as small as possible and be well insulated. Since the U-shaped rider embraces opposite sides of the rail, it is apparent that the dimensions of the rider and rail are undesirably large, thereby screening heat from the underside of the workpiece.

In another known application, the rider has a circular configuration so that only line contact is made between the rider and the workpiece. However, this is not satisfactory since the upper structural limit at which the rider will become damaged by heat is not reduced. Also, the rail is partially surrounded by ceramic insulating sleeves which leave a wide gap therebetween to receive the rider. This is disadvantageous because contaminants enter the gap and, over time, tend to expand and destroy the ceramic-insulating sleeves. Still another drawback is that side extensions are used to engage opposite sides of the rider so as to partially overlap the gap. However, the entry of contaminants is still not altogether prevented.

SUMMARY OF THE INVENTION

Accordingly, it is a general object of the present invention to overcome the disadvantages of the prior art.

Another object of the present invention is to economically manufacture a rider which utilizes a minimum of highly expensive heat-resistant material.

Another object of the present invention is to improve the uniform heating of both sides of a workpiece by substantially reducing the formation of undercooled zones on the underside of the workpiece.

Yet another object of the present invention is to reduce the size of a rider so as to prevent heat from being screened from the underside of a workpiece.

An additional object of the present invention is to provide a rider which does not scratch or score the workpiece engaged thereby.

In keeping with these objects and others which will become apparent hereinafter, one feature of the invention resides, briefly stated, in a combination in a furnace for heat treating of workpieces which comprises an elongated internally-cooled supporting member for supporting workpieces which are to be advanced through the furnace. A plurality of workpiece-engaging elements or riders each have a lower portion mounted on the supporting member and an upper portion having an upwardly-directed planar surface which is adapted to support the workpieces from below. Each lower portion has a smaller cross-section than its corresponding upper portion.

This particular configuration for the rider is important in substantially reducing the non-uniform heating effect caused by the supporting member or rail. Thus, the relatively smaller lower portion which is mounted on the rail permits the latter to be correspondingly smaller which, in turn, means that less heat energy is screened from the underside of a workpiece. Also, the relatively larger upper portion permits its upwardly-directed planar surface to support a workpiece with minimal risk that the structural breaking strength of the rider will be exceeded even though the temperature is greatest and therefore the structural rigidity is weakest at this planar surface. Moreover, the flatness of the planar surface assures that scratching of the underside of the workpiece is reduced as it travels through the furnace.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
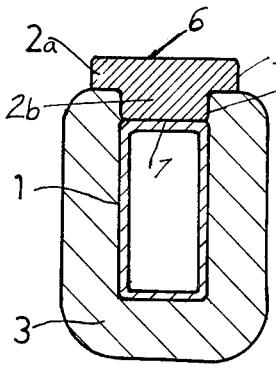
FIG. 1 is a cross-sectional view of a first embodiment according to the present invention.

Referring now to the drawing, reference numeral 1 is consistently used to identify a rail or elongated, internally-cooled supporting member. Although in FIGS. 1, 2 and 4, the supporting member 1 is shown as having a quadrilateral cross-sectioned configuration and, in FIG. 3, the supporting member 1 is shown as having a circular configuration, it will be understood that the supporting member 1 may have any cross-sectional configuration and that the invention is not intended to be only limited to the illustrated cross-sections.

Figure 2:
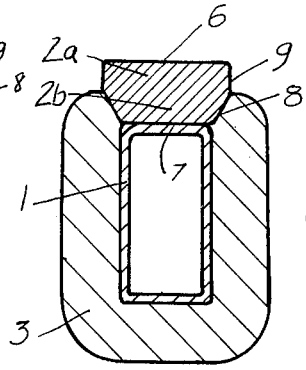
FIG. 2 is a cross-sectional view of a second embodiment according to the present invention.
Figure 3:
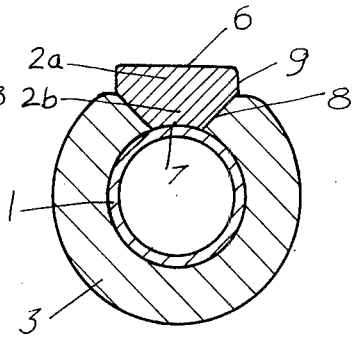
FIG. 3 is a cross-sectional view of a third embodiment according to the present invention.
Figure 4:
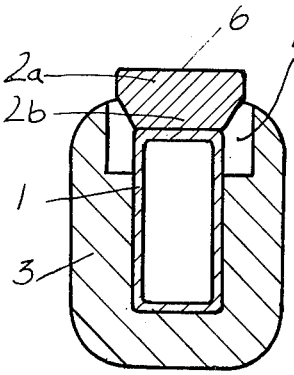
FIG. 4 is a cross-sectional view of a fourth embodiment according to the present invention.

Reference numeral *2a* is consistently used to identify the upper portion of the workpiece-engaging elements or riders; and reference numeral *2b* is used to identify the lower portions of the riders. Lower portion *2b* has a mounting face 7 which faces a side of the supporting member 1 and which is mounted thereon. In FIGS. 1, 2 and 4, the mounting face 7 is planar and is mounted in surface engagement with the planar upper side of the rectangularly-shaped supporting member 1. In FIG. 3, the mounting face 7 is shaped as an arc and is mounted in surface engagement with the upper curved surface of the circular-shaped supporting member 1. Each of the upper portions *2a* of the riders has an upwardly-directed planar surface 6 which is adapted to support the workpieces by contact with the underside of the workpieces from below.

Furthermore, it will be seen that the lower portions *2b* of each of the illustrated riders has a reduced cross-sectional dimension as compared with the respectively-associated upper portions *2a*. Thus, the sidewalls 8 of lower portion *2b* in FIG. 1 are spaced inwardly of the sidewalls 9 of upper portion *2a* so as to resemble a T-shaped cross-section. The walls 8 are substantially parallel to each other and extend in direction substantially normal to said planar surface 6. As for the riders of FIGS. 2–4, the side walls 8 diverge in direction away from each other in direction from the lower portion *2b* towards the upper planar surface 6.

Each rider is constituted of heat-resistant material, such as metal or ceramic material, and is preferably of one-piece construction. Furthermore, heat-insulating means, preferably ceramic insulating material 3, surrounds at least in part the supporting member 1. The heat insulating means 3 is placed about the supporting member 1 until it abuts against the walls of the rider.

I have found that the particular dimensions chosen for the rider are extremely important in substantially reducing the effect that the supporting rail has in preventing the non-uniform heating treatment of the workpieces to be advanced through a furnace or analogous heating chamber in which the supporting member 1 is located. Thus, it is advantageous if the transverse width of the mounting face 7 is between one-half and three-quarters of the transverse width of the planar surface 6. In particular, if the planar surface 6 has a width of between 60–100 millimeters, than the width of the mounting face 7 is to be about 25 millimeters less wide.

It is further advantageous if the overall height of the rider is 50 millimeters, that the walls 9 of the upper portion *2a* have a thickness about equal to one-half of the overall height or 25 millimeters.

The riders described above, in accordance with the invention, have a relatively wide upper portion. This is especially desirable because the upper planar surface 6 is furthest from the cooling effect of the cooling fluid being circulated through the interior of the supporting member 1. Since the surface 6 is subjected to the most extreme heating as compared with the other regions of the rider, the surface 6 is generally always near the upper limit at which the material constituting the upper portion *2a* will deform due to the excessive heat at the surface 6. Thus, since the upper portion *2a* which contacts the workpieces is relatively wide, only a very slight specific weight stresses the upper portion, thereby minimizing the danger of exceeding the structural breaking strength of the rider even under the aforementioned elevated temperature condition.

The lower portion *2b* has a smaller cross-section than the upper portion *2a* for several reasons. Firstly, the lower portion does not require a relatively large cross-section since the lower portion is closer to the cooling and therefore it is not so readily close to the upper limit at which it begins to deform due to the heat. Secondly, the lower portion *2b* does not support the entire workpiece since part of the weight is supported by the heat-insulating means 3. Finally, by reducing the cross-section of the lower part, the conduction resistance is correspondingly increased which, in turn, aids in insulating the workpiece.

The smaller cross-section of the lower portion *2b* is advantageous for another important reason. This feature permits the supporting member 1 and its ceramic insulating 3 to be correspondingly smaller than was heretofore known by prior-art constructions. The cooling generated by the supporting member 1 and the heat-screening caused by the presence and the location of the supporting member 1 both tend to adversely affect the uniform heating of a workpiece. The high temperatures are less hindered in reaching the workpiece, the narrower the supporting member is and, of course, the smaller the supporting member, the less heat-insulation 3 is required.

The configuration of the rider according to the present invention permits the upper portion *2a* to transmit the weight of the workpiece from the upper surface 6 towards the lower mounting surface 7 without the material of the rider being overstressed. The broad, planar, horizontal shape of the upper surface 6 can accommodate high load conditions, such as heavy, thick-walled workpieces. No necessity exists for shaping the upper surface 6 into a curved configuration since, under normal furnace operation, such thick-walled workpieces do not tend to bend as they advance between elongated supporting rails. As for thin-walled, flexible workpieces, their weight is so low that it is likewise unnecessary to shape the upper surface into a curved configuration.

The flat, horizontal and wide surface 6 also substantially reduces wear. The weight of a workpiece is distributed over a wide area and therefore reduces the risk of fracture. Also, scratch marks on the workpieces are safely prevented because the specific weight is smaller, that is the loading at any particular point on the surface 6 is reduced. Moreover, scratch marks are reduced because the difference in the hardness between the contacting materials is smaller as the upper surface heats up. The material of the rider is generally chosen to have long-life and high-strength characteristics.

Figure 5:
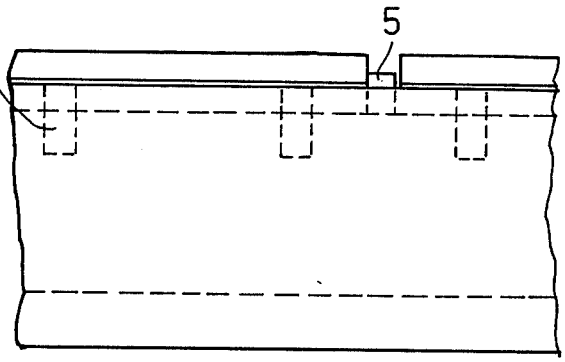
FIG. 5 is a side view of the embodiment shown in FIG. 4.

Further in accordance with the invention, FIGS. 4 and 5 show retaining means 4, 5 which are provided to hold the riders on the supporting member 1. In order to prevent horizontally-directed forces which are transverse to the elongation of the supporting member 1 from knocking the riders off the supporting member 1, small laterally-spaced arms 4 are positioned on opposite sides of a rider so as to straddle the supporting member. In order to further secure the rider, the arms may be welded to the supporting member.

In order to prevent longitudinally-directed forces which are directed along the elongation of the supporting member 1, small abutments 5 are welded to the supporting member 1. Abutments 5 may be arranged between successive riders or in corresponding recesses formed in the riders themselves.

It will be understood that each of the elements described above, or two or more together, may also find a useful application in other types of constructions differing from the types described above.

While the invention has been illustrated and described as embodied in a workpiece-engaging element for furnaces, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a furnace for heat treating workpieces, a combination comprising an elongated internally-cooled supporting member for supporting workpieces which are to be advanced through the furnace; and a plurality of workpiece-engaging elements of one-piece constructions each having a lower portion mounted on said supporting member and an upper portion having an upwardly-directed planar surface which is adapted to support the workpieces from below, said lower portion having a smaller cross-section than said upper portion, wherein said supporting member has a side facing said lower portions of said elements, and wherein each of said lower portions has a mounting face in surface engagement with said side of said supporting member wherein said lower portion has a pair of spaced sidewalls which diverge away from each other in direction from said lower portion towards said upwardly-directed planar surface of said upper portion.

2. A combination as defined in claim 1 each of said mounting faces having a width which is between one-half and three-quarters of the width of said upwardly-directed planar surface of the respective upper portions.

3. A combination as defined in claim 1, wherein each of said elements has a predetermined height, and wherein said upper portions have a height which is about one-half of said predetermined height.

4. A combination as defined in claim 1, wherein each of said elements has a predetermined height; and wherein each of said upwardly-directed planar surfaces of said upper portions has a width of between 60–100 millimeters and wherein each mounting face has a width of between 35–75 millimeters; and wherein each of said upper portions has a height which is about one-half of said predetermined height of said element.

5. A combination as defined in claim 1, wherein each of said elements is constituted of heat-resistant metal material; and further comprising heat-insulating means partially surrounding said supporting member and abutting opposite sidewalls of said lower portions.

6. A combination as defined in claim 1; and further comprising means for retaining said elements on said supporting member.

7. A combination as defined in claim 6, wherein said retaining means comprise a pair of laterally-spaced arms straddling and fixedly secured to opposite sides of said supporting member.

8. A combination as defined in claim 6, wherein said retaining means comprises a plurality of holding members fixedly secured to said supporting member and located in direction of the elongation thereof between adjacent elements.

9. A combination as defined in claim 6, wherein said retaining means comprises a plurality of holding members fixedly secured to said supporting member and located in recesses formed in said elements.

10. A combination as defined in claim 1, wherein said elements are each made of a heat-resistant metal.

11. A combination as defined in claim 1, wherein said side of supporting member facing said lower portion of said element is planar and wherein said mounting face of each of said lower portions is planar.

12. A combination as defined in claim 1, wherein said side of said supporting member is curved, and wherein said mounting face is curved.

* * * * *